US011349213B2

(12) United States Patent
Wu et al.

(10) Patent No.: US 11,349,213 B2
(45) Date of Patent: May 31, 2022

(54) ANTENNA STRUCTURE AND SINGLE DUAL-POLARIZATION ANTENNA ARRAY

(71) Applicant: PEGATRON CORPORATION, Taipei (TW)

(72) Inventors: Chien-Yi Wu, Taipei (TW); Yi-Ru Yang, Taipei (TW); Shih-Keng Huang, Taipei (TW); Chao-Hsu Wu, Taipei (TW); Tse-Hsuan Wang, Taipei (TW); Hau Yuen Tan, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 88 days.

(21) Appl. No.: 17/081,371

(22) Filed: Oct. 27, 2020

(65) Prior Publication Data

US 2021/0203072 A1 Jul. 1, 2021

(30) Foreign Application Priority Data

Dec. 27, 2019 (TW) ..... 108148197

(51) Int. Cl.

| | |
|---|---|
| ***H01Q 1/38*** | (2006.01) |
| ***H01Q 5/35*** | (2015.01) |
| ***H01Q 1/48*** | (2006.01) |
| ***H01Q 21/24*** | (2006.01) |
| ***H01Q 9/04*** | (2006.01) |
| *H01Q 1/24* | (2006.01) |

(52) U.S. Cl.

CPC ..... *H01Q 5/35* (2015.01); *H01Q 1/48* (2013.01); *H01Q 9/0414* (2013.01); *H01Q 21/24* (2013.01); *H01Q 1/241* (2013.01)

(58) Field of Classification Search

CPC ..... H01Q 5/35; H01Q 1/48; H01Q 9/0414; H01Q 21/24; H01Q 1/241; H01Q 1/52

USPC ..... 343/846

See application file for complete search history.

(56) References Cited

U.S. PATENT DOCUMENTS

| | | | | |
|---|---|---|---|---|
| 9,692,125 | B1 * | 6/2017 | Channabasappa | H01Q 5/385 |
| 2010/0090903 | A1 | 4/2010 | Byun et al. | |
| 2014/0361952 | A1 * | 12/2014 | Dobric | H01Q 21/00 343/893 |

(Continued)

FOREIGN PATENT DOCUMENTS

| | | |
|---|---|---|
| CN | 205016667 | 2/2016 |
| JP | 3212084 | 9/2001 |

(Continued)

*Primary Examiner* — Peguy Jean Pierre

(74) *Attorney, Agent, or Firm* — J.C. Patents

(57) ABSTRACT

An antenna structure includes a ground, a first patch, a second patch, a first conductive post, and a second conductive post. The first patch is spaced apart from the ground. The first patch includes a circular slit, a main patch portion and a circular portion. The circular portion and the circular slit surround the main patch portion, and the circular slit is located between the main patch portion and the circular portion. The second patch is disposed between and spaced apart from the ground and the main patch portion. A dimension of the second patch is less than a dimension of the main patch portion. One end of the first conductive post is connected to the second patch. Another end of the first conductive post passes through the ground and is coupled to a signal feeding end. The circular portion is connected to the ground through the second conductive post.

16 Claims, 13 Drawing Sheets

(56) References Cited

U.S. PATENT DOCUMENTS

| | | | | |
|---|---|---|---|---|
| 2015/0236424 | A1 | 8/2015 | Panther et al. | |
| 2018/0366347 | A1* | 12/2018 | Chuang | H01L 24/25 |

FOREIGN PATENT DOCUMENTS

| | | |
|---|---|---|
| TW | 201017976 | 5/2010 |
| TW | I594502 | 8/2017 |

* cited by examiner

Right-hand circular polarization
Left-hand circular polarization

Right-hand circular polarization
Left-hand circular polarization

ANTENNA STRUCTURE AND SINGLE DUAL-POLARIZATION ANTENNA ARRAY

CROSS-REFERENCE TO RELATED APPLICATION

This application claims the priority benefit of Taiwan application serial no. 108148197, filed on Dec. 27, 2019. The entirety of the above-mentioned patent application is hereby incorporated by reference herein and made a part of this specification.

BACKGROUND

Technical Field

The disclosure relates to an antenna structure and a single dual-polarization antenna array.

Description of Related Art

The $5^{th}$ generation mobile communication (5G) is currently the mainstream. The applicable band of the millimeter wave n257 for the 5G mobile communication is 26.5-29.5 GHz, which is a 28-GHz millimeter wave, while the applicable band of n260 is 37-40 GHz and belongs to a 39-GHz millimeter wave. Since the frequency ranges of the two bands are close to each other, it is difficult for an antenna structure to cover the bands with close frequency ranges.

SUMMARY

The disclosure provides an antenna structure that can cover two bands with close frequency ranges.

The disclosure provides a single dual-polarization antenna array that includes the foregoing antenna structure.

The antenna structure provided in the disclosure includes a ground, a first patch, a second patch, a first conductive post, and a second conductive post. The first patch is spaced apart from the ground. The first patch includes a circular slit, a main patch portion and a circular portion. The circular portion and the circular slit surround the main patch portion, and the circular slit is located between the main patch portion and the circular portion. The second patch is disposed between and spaced apart from the ground and the main patch portion. A dimension of the second patch is less than a dimension of the main patch portion. One end of the first conductive post is connected to the second patch, and the other end of the first conductive post passes through the ground and is coupled to a signal feeding end. The circular portion is connected to the ground through the second conductive post.

The single dual-polarization antenna array provided in the disclosure includes at least one antenna group, each of the at least one antenna group includes a first antenna structure and a second antenna structure, the first antenna structure is connected to the second antenna structure in a first direction, and a first patch of the first antenna structure and a first patch of the second antenna structure are located on a same plane and disposed perpendicularly to each other on the plane.

Based on the foregoing, in the antenna structure provided in the disclosure, the first patch is spaced from the ground, and the first patch is divided into the main patch portion and the circular portion that surrounds the main patch portion by the circular slit. The second patch is disposed between and spaced apart from the ground and the main patch portion. The first conductive post that includes the signal feeding end extends from the second patch to the ground, and the second conductive post that includes a ground end extends from the circular portion to the ground. The design allows the second patch to be coupled to the first patch to form a resonant architecture including a series resonant circuit, which can cover two bands with close frequency ranges, such as 28 GHz and 39 GHz. In addition, the first antenna structure and the second antenna structure of the single dual-polarization antenna array provided in the disclosure are disposed perpendicularly to each other with a phase difference of 90 degrees. The design allows the two bands (for example, 28 GHz and 39 GHz) with close frequency ranges to exhibit dual band as well as dual polarization.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
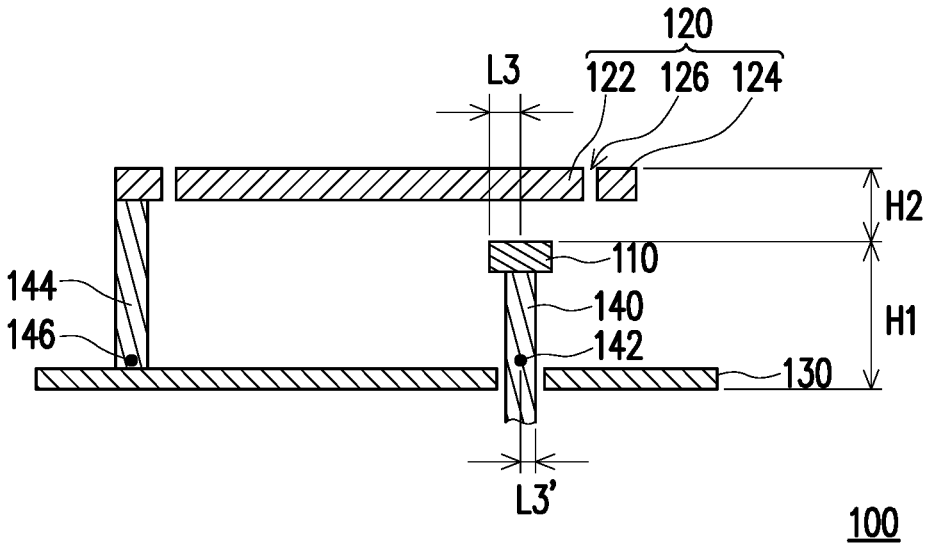
FIG. 1 is a schematic cross-sectional diagram of an antenna structure according to an embodiment of the disclosure.
Figure 2:
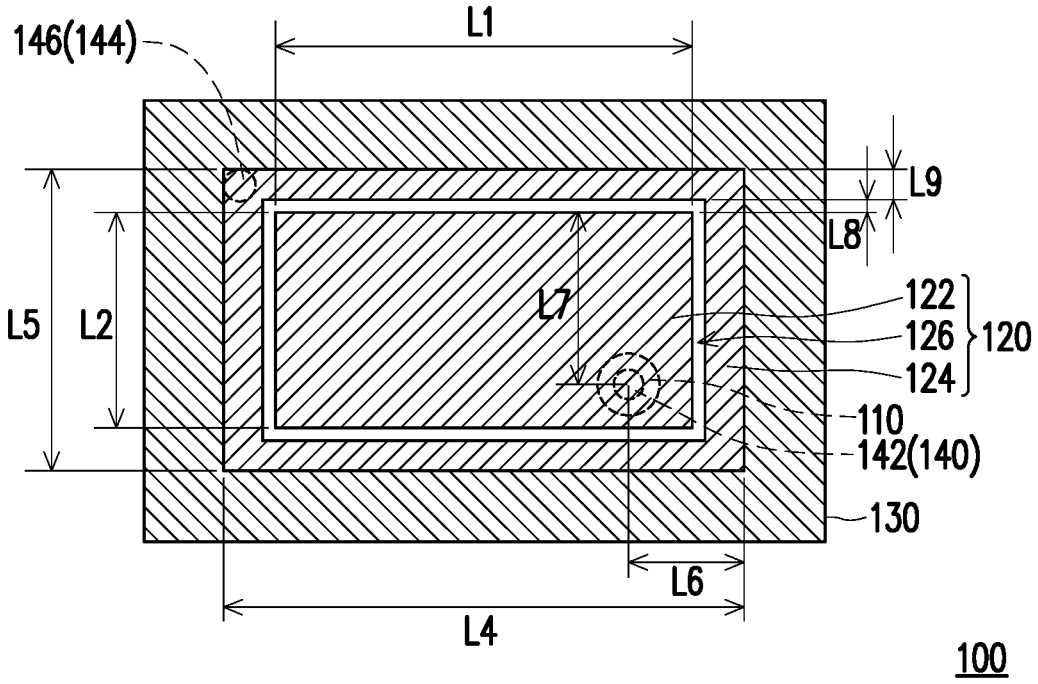
FIG. 2 is a schematic top view of the antenna structure.

FIG. 1 is a schematic cross-sectional diagram of an antenna structure according to an embodiment of the disclosure. FIG. 2 is a schematic top view of the antenna structure. Referring to FIG. 1 and FIG. 2, in the present embodiment, the antenna structure 100 includes a ground 130, a first patch 120, a second patch 110, a first conductive post 140, and a second conductive post 144.

The first patch 120 is spaced apart from the ground 130. As shown in FIG. 2, an outer contour of the first patch 120 is a rectangle. The first patch 120 includes a circular slit 126, a main patch portion 122, and a circular portion 124. The circular portion 124 and the circular slit 126 surround the main patch portion 122, and the circular slit 126 is located between the main patch portion 122 and the circular portion 124. In the present embodiment, a shape of the circular slit 126 is a rectangle, and the circular slit 126 has a same slit width at four sides of the rectangle.

A length L1 of the main patch portion 122 ranges from 2.5 mm to 3 mm. In the present embodiment, the length L1 is preferably 2.7 mm. A width L2 of the main patch portion 122 ranges from 1.5 mm to 2 mm. In the present embodiment, the width L2 is preferably 1.7 mm. A length L4 of the rectangular contour of the first patch 120 ranges from 3 mm to 3.5 mm. In the present embodiment, the length L4 is preferably 3.1 mm. A width L5 of the rectangle ranges from 2 mm to 2.5 mm. In the present embodiment, the width L5 is preferably 2.1 mm. A width L8 of the circular slit 126 ranges from 0.03 mm to 0.08 mm. In the present embodiment, the width L8 is preferably 0.05 mm. A distance L9 between an inner edge and an outer edge of the circular portion 124 ranges from 0.1 mm to 0.3 mm. In the present embodiment, the distance L9 is preferably 0.15 mm. Certainly, the foregoing dimensions are not limited thereto.

In addition, as shown in FIG. 1, the second patch 110 is disposed between and spaced apart from the ground 130 and the main patch portion 122. In the present embodiment, a distance H1 between a bottom surface of the ground 130 and a top surface of the second patch 110 ranges from 0.5 mm to 0.9 mm. In the present embodiment, the distance H1 is preferably 0.7 mm. A distance H2 between the top surface of the second patch 110 and a top surface of the first patch 120 ranges from 0.03 mm to 0.07 mm. In the present embodiment, the distance H2 is preferably 0.05 mm. Certainly, the foregoing dimensions are not limited thereto.

One end of the first conductive post 140 is connected to the second patch 110, and another end of the first conductive post 140 passes through the ground 130 and is coupled to a signal feeding end 142. The second conductive post 144 connects the circular portion 124 to the ground 130 and a ground end 146 is located on the second conductive post 144. A dimension of the second patch 110 is less than a dimension of the main patch portion 122. A radius L3 of the second patch 110 ranges from 0.15 mm to 0.25 mm. In the present embodiment, the radius L3 is preferably 0.2 mm. A radius L3' of the first conductive post 140 and the second conductive post 144 ranges from 0.05 mm to 0.2 mm. In the present embodiment, the radius L3' is preferably 0.1 mm. Certainly, the foregoing dimensions are not limited thereto.

As shown in FIG. 2, a projection of the second patch 110 on the main patch portion 122 is located at a main patch corner of the main patch portion 122. The second conductive post 144 is located at a circular portion corner, and the circular portion corner is located at a diagonal position, which is farthest from the main patch corner of the main patch portion 122, of the circular portion 124. More specifically, the projection of the second patch 110 on the main patch portion 122 is located at a lower right corner of the main patch portion 122, and the second conductive post 144 is located at an upper left corner, which is farthest from the main patch corner of the main patch portion 122, of the circular portion 124. In other words, the second patch 110 (and the first conductive post 140) and the second conductive post 144 may be located at two diagonal corners of the main patch portion 122. In the present embodiment, a shape of the second patch 110 is a circle, but in other embodiments, the shape of the second patch 110 may be a polygon. The second patch 110 may be in any shape, and a designer can adjust the shape according to required inductance.

A minimum distance L6 between a projection of a center of the first conductive post 140 on a plane of the first patch 120 and a short patch side of the rectangle ranges from 0.4 mm to 0.7 mm. In the present embodiment, the distance L6 is preferably 0.55 mm. A distance L7 between the center of the first conductive post 140 and a farther long side of the main patch portion 122 ranges from 1.3 mm to 1.6 mm. In the present embodiment, the distance L7 is preferably 1.45 mm.

In the present embodiment, a radio frequency signal from the signal feeding end 142 passes through the first conductive post 140 to the second patch 110, and is coupled to a slit (space) between the second patch 110 and the first patch 120. In other words, a capacitance binding is provided to form a series LC resonant architecture, which is configured to adjust impedance matching resonant bandwidths of 28 GHz and 39 GHz. In addition, the circular slit 126 is designed on the first patch 120, and is connected to the ground 130 through the circular portion 124 and the second conductive post 144, so as to optimize an impedance matching bandwidth of 39 GHz and improve an impedance matching resonant point of 28 GHz.

Figure 3A:
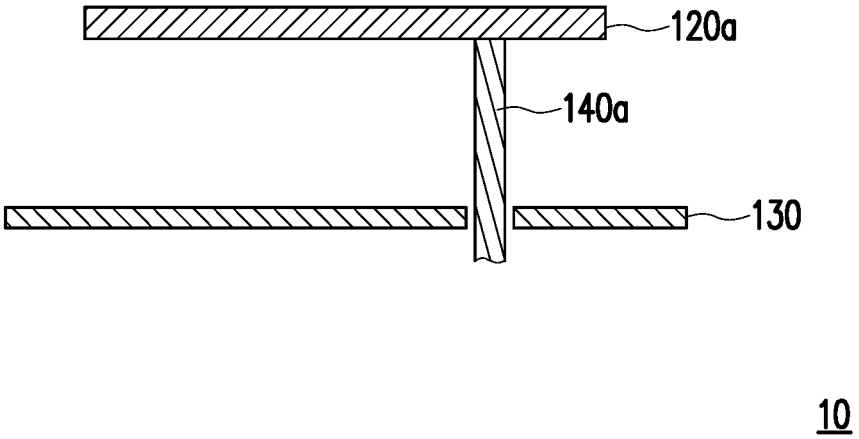
FIG. 3A and FIG. 3B are schematic cross-sectional diagrams of another two antenna structures.
Figure 3B:
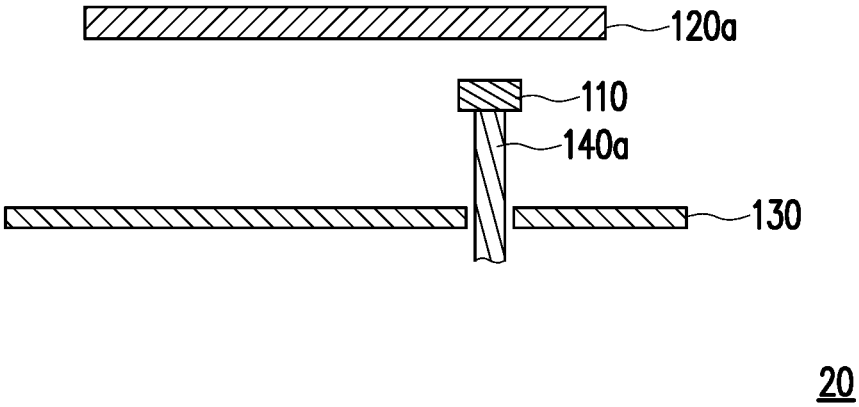

FIG. 3A and FIG. 3B are schematic cross-sectional diagrams of another two antenna structures. Referring to FIG. 3A and FIG. 3B, a first patch 120*a* of an antenna structure 10 shown in FIG. 3A does not include the circular slit 126 in FIG. 1, the antenna structure 10 does not include the second patch 110, and a first conductive post 140*a* is directly connected to the first patch 120*a*. The antenna structure 10 does not include the second conductive post 144, either. A first conductive post 140*a* of an antenna structure 20 shown in FIG. 3B is connected to a second patch 110, but the antenna structure 20 does not include the circular slit 126 and the second conductive post 144 in FIG. 1.

Figure 3C:
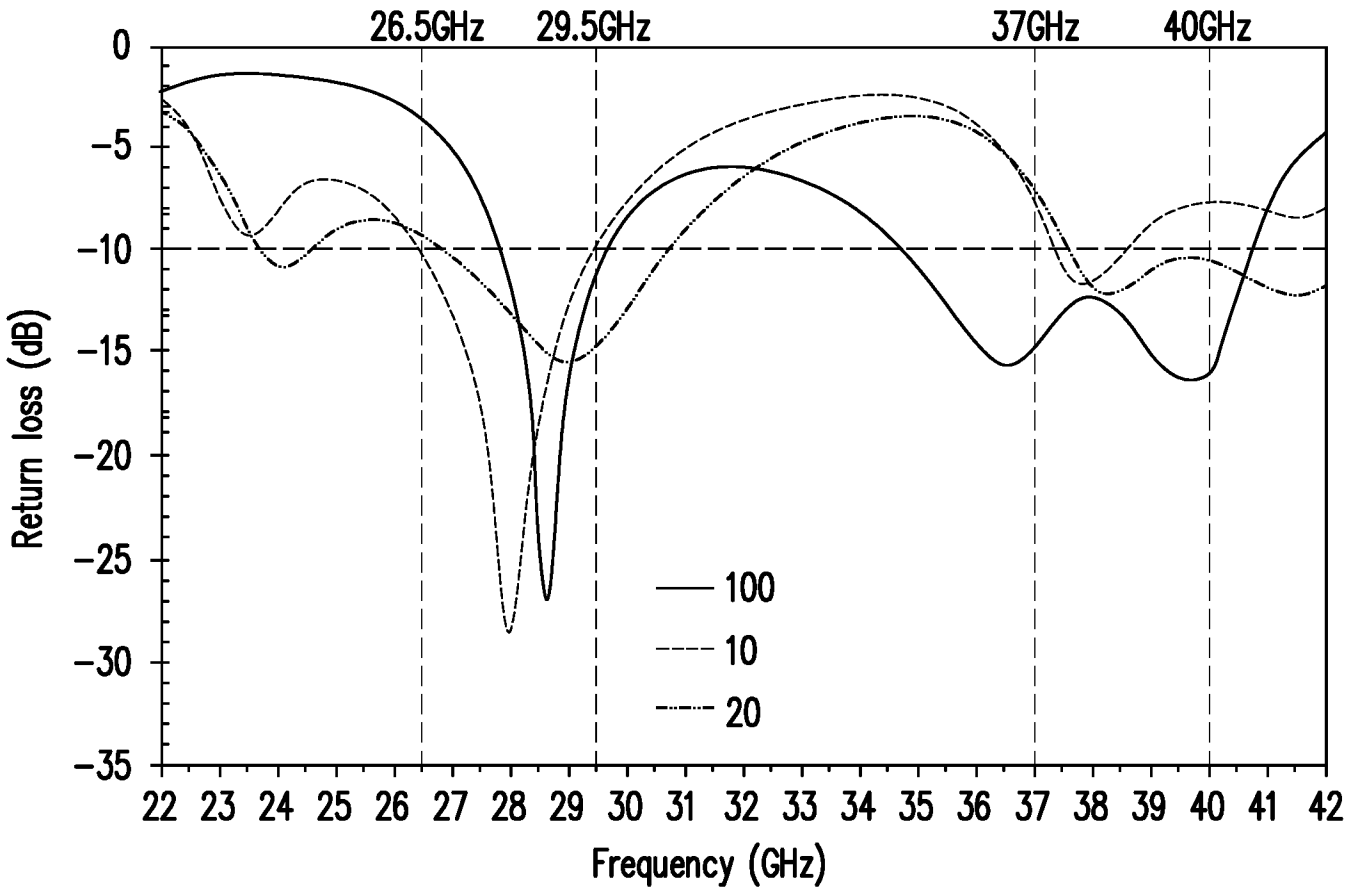
FIG. 3C is a frequency-return loss relationship diagram of the antenna structures shown in FIG. 1, FIG. 3A, and FIG. 3B.

FIG. 3C is a frequency-return loss relationship diagram of the antenna structures shown in FIG. 1, FIG. 3A, and FIG. 3B. It can be seen from comparison based on FIG. 3C that the antenna structure 10 shown in FIG. 3A has a poor impedance matching effect at 39 GHz, and resonant bands of the antenna structure 20 shown in FIG. 3B are relatively higher than 28 GHz and 39 GHz. Return loss of the antenna structure 100 shown in FIG. 1 is equal to or less than −10 dB when impedance matching at the two bands of 28 GHz and 39 GHz. The antenna structure 100 has a frequency range of 27.5-29.7 GHz and a bandwidth proportion of 5.8% to 6.3% at 28 GHz, and has a frequency range of 34.1-40.7 GHz and a bandwidth proportion of 15.9% to 16.8% at 39 GHz. Therefore, the antenna structure 100 features with a dual-band millimeter-wave applicable band antenna.

Figure 4A:
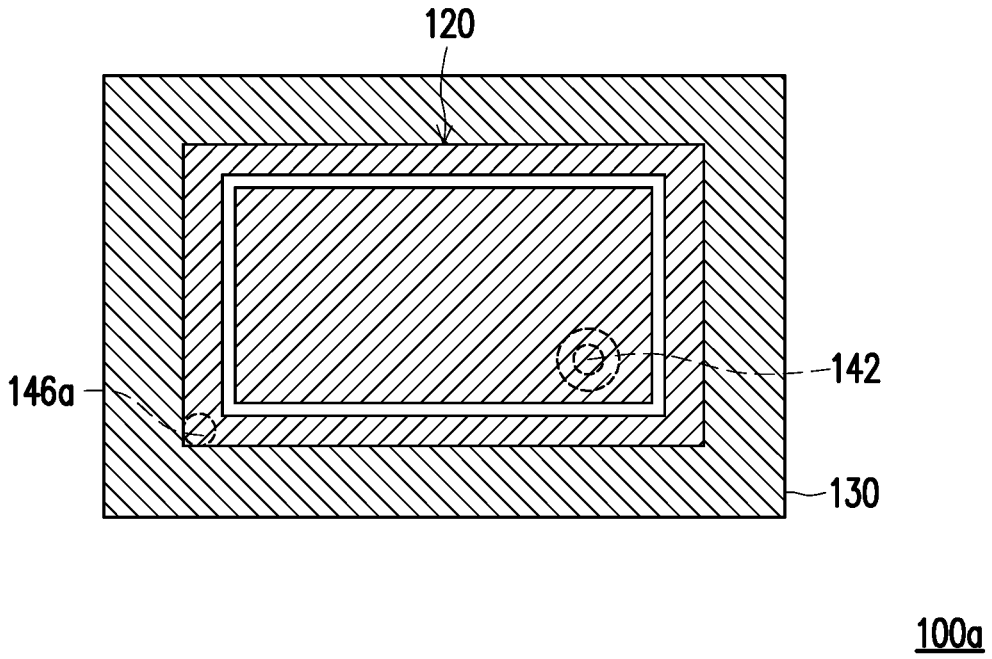
FIG. 4A to FIG. 4C are schematic top views of a plurality of antenna structures.
Figure 4B:
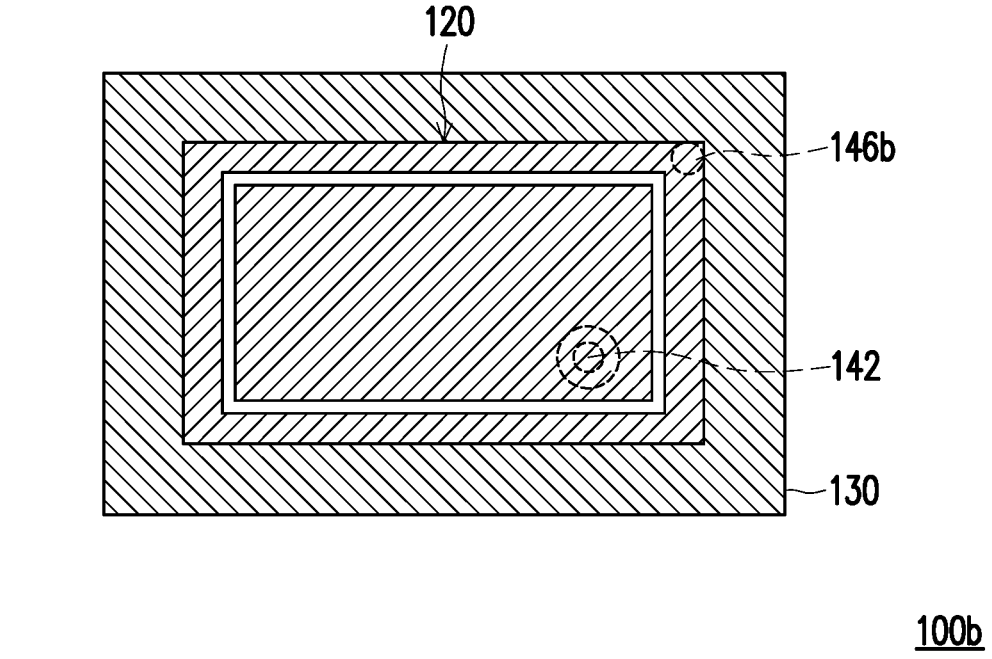
Figure 4C:
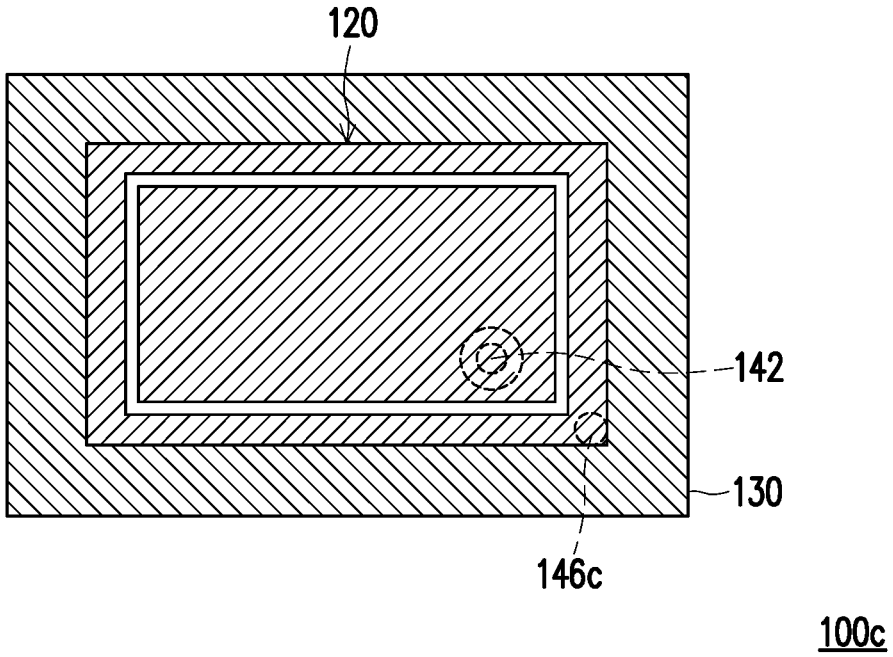
Figure 4D:
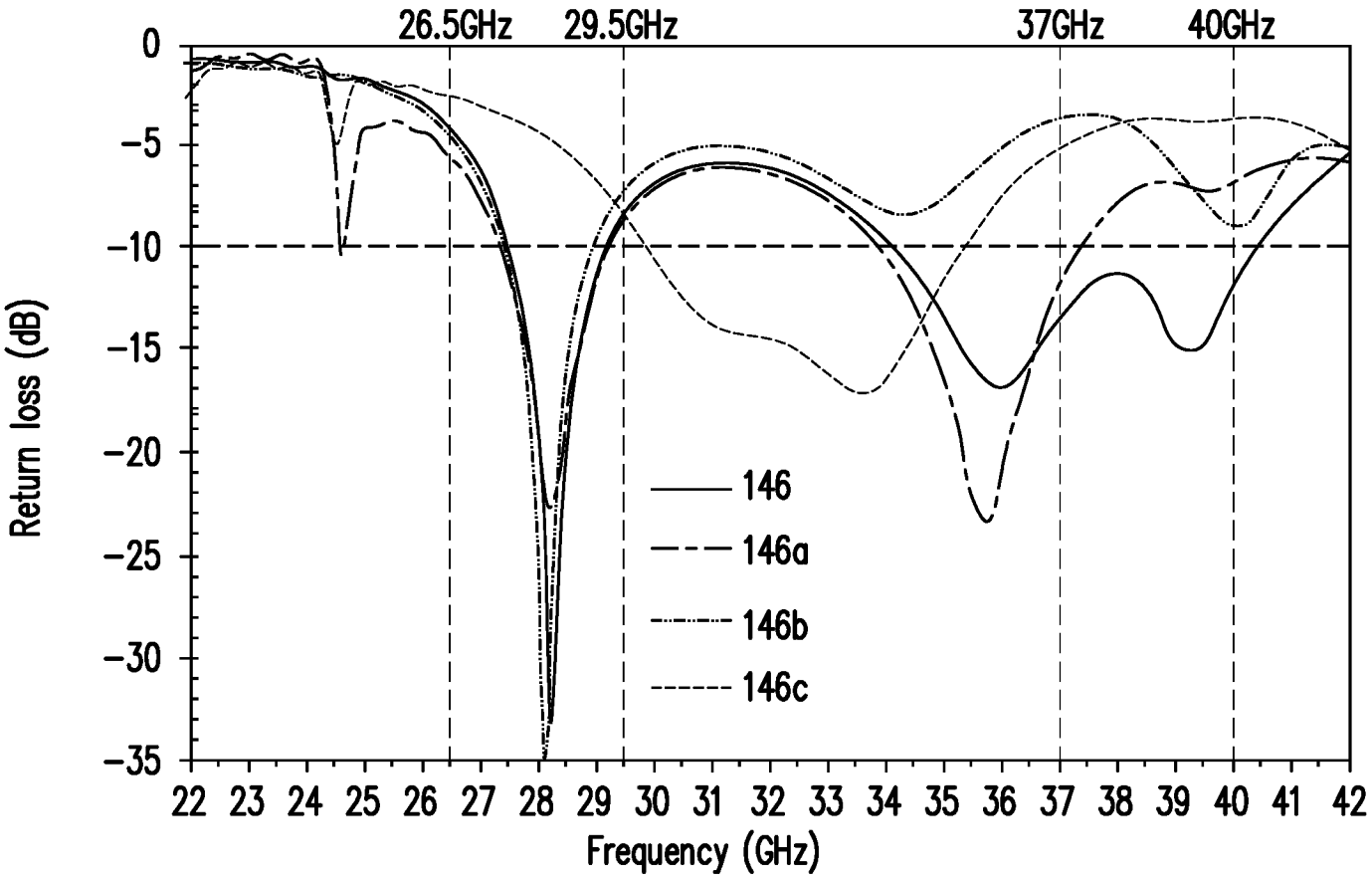
FIG. 4D is a frequency-return loss relationship diagram of the plurality of antenna structures shown in FIG. 2 and FIG. 4A to FIG. 4C.

FIG. 4A to FIG. 4C are schematic top views of a plurality of antenna structures. The plurality of antenna structures are different in a position of a ground end 146. Referring to FIG. 4A to FIG. 4C, different from the ground end 146 of the antenna structure 100 that is located at an upper left corner of the circular portion 124 in FIG. 2, a ground end 146*a* of an antenna structure 100*a* is located at a lower left corner of a circular portion 124 in FIG. 4A. In FIG. 4B, a ground end 146*b* of an antenna structure 100*b* is located at an upper right corner of a circular portion 124. In FIG. 4C, a ground end 146*c* of an antenna structure 100*c* is located at a lower right corner of a circular portion 124. FIG. 4D is a frequency-return loss relationship diagram of the plurality of antenna structures shown in FIG. 2 and FIG. 4A to FIG. 4C. Referring to FIG. 4D, it can be clearly seen that when the ground end 146 is located at the upper left corner of the circular portion 124 in FIG. 2, the second patch 110 (and the first conductive post 140) and the second conductive post 144 may be located at two diagonal corners of the main patch portion 122, generating a favorable dual-band resonant effect.

Figure 5:
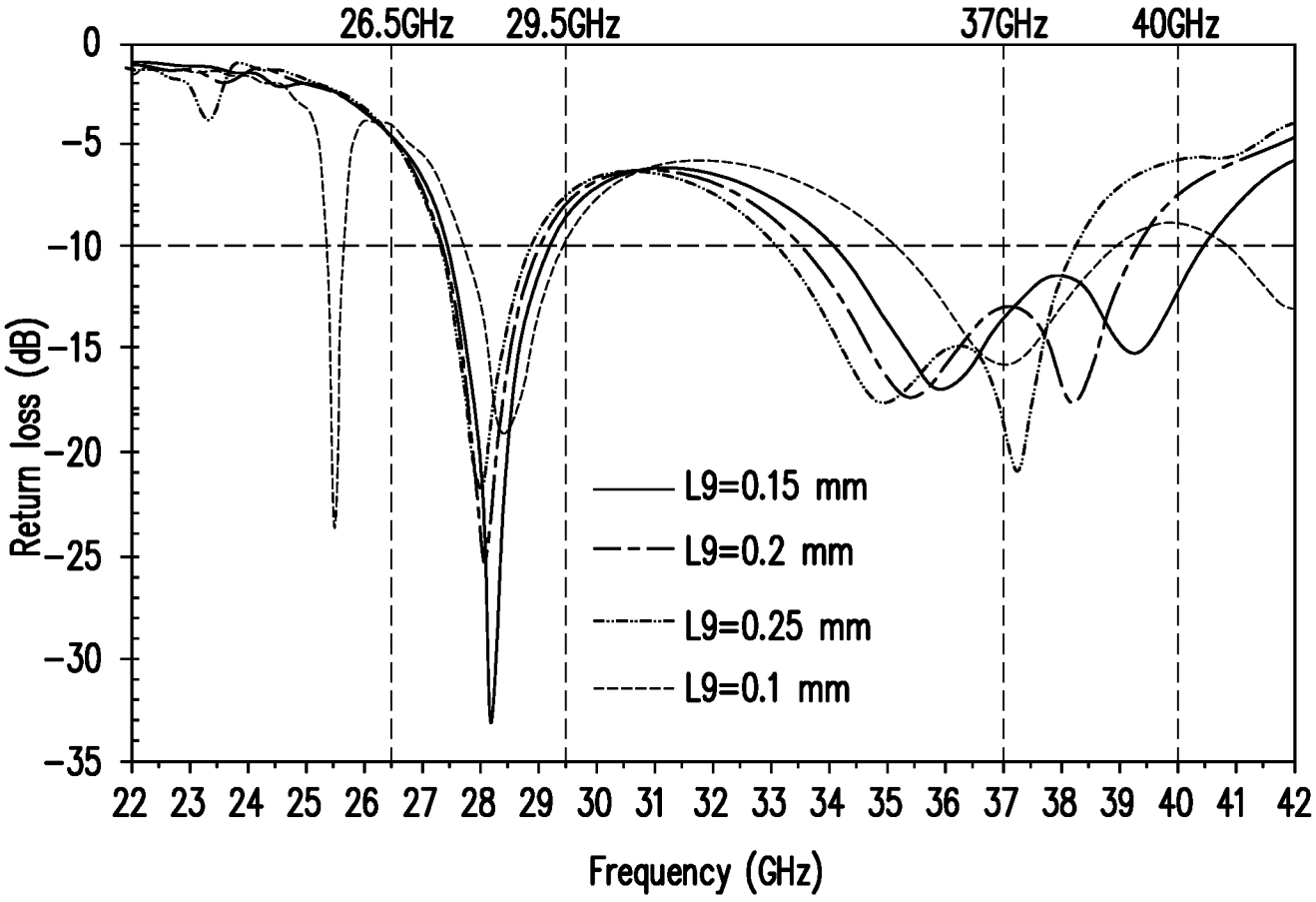
FIG. 5 is a frequency-return loss relationship diagram of an antenna structure including a circular slit whose width is set to a plurality of values.

FIG. 5 is a frequency-return loss relationship diagram of an antenna structure including a circular portion whose width is set to a plurality of values. Referring to FIG. 2 and FIG. 5, frequency-return loss tests are performed with the distance L9 between the inner edge and the outer edge of the circular portion 124 (that is, a line width of the circular portion 124) set to 0.15 mm, 0.2 mm, 0.25 mm, and 0.1 mm, respectively. As can be seen from FIG. 5, when the distance L9 between the inner edge and the outer edge of the circular portion 124 is 0.15 mm, a favorable resonant effect at 39 GHz is exhibited.

Figure 6:
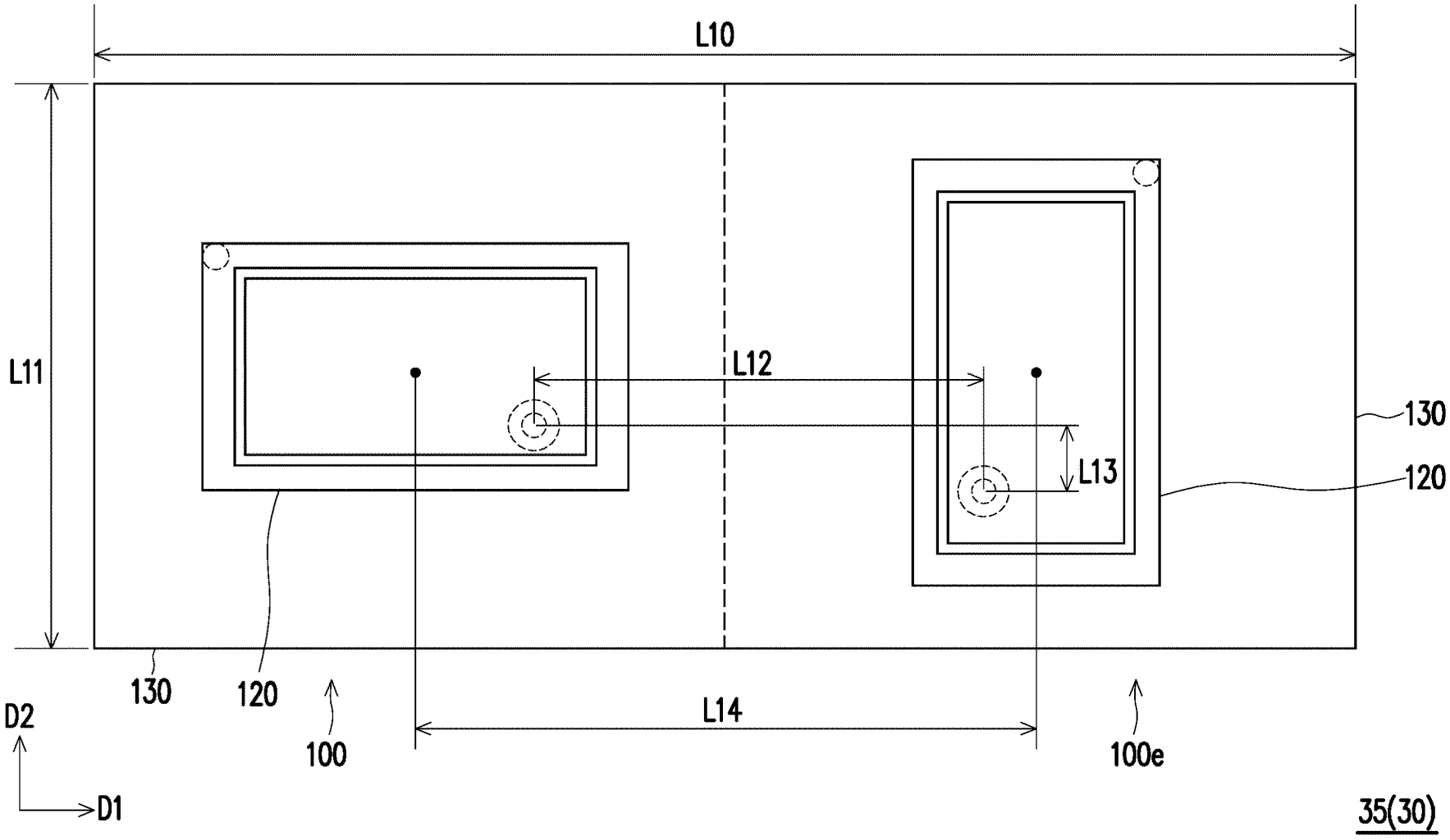
FIG. 6 is a schematic diagram of a single dual-polarization antenna array according to an embodiment of the disclosure.

FIG. 6 is a schematic diagram of a single dual-polarization antenna array according to an embodiment of the disclosure. Referring to FIG. 6, the single dual-polarization antenna array 30 in the present embodiment is an antenna group 35, and the antenna group 35 includes an antenna structure 100 (a first antenna structure) and an antenna structure 100*e* (a second antenna structure). First patches 120 of the antenna structures 100 and 100*e* are located on a same plane, and are disposed perpendicularly to each other on the plane. In other words, a long patch side of the first patch 120 of the antenna structure 100 is perpendicular to a long patch side of the first patch 120 of the antenna structure 100*e*.

Specifically, in the present embodiment, the single dual-polarization antenna array 30 includes the antenna group 35, and the two first patches 120 of the two antenna structures 100 and 100*e* in the antenna group 35 are disposed with a phase difference of 90 degrees to form a group of dual-polarization antenna structures. Two grounds 130 of the two antenna structures 100 and 100*e* are located on a same plane, and a length L10 of a long side of a ground formed by the two grounds 130 ranges from 9 mm to 12 mm. In the present embodiment, the length L10 is preferably 10.72 mm. A width L11 of a short side of the ground formed by the two grounds 130 ranges from 5 mm to 6 mm. In the present embodiment, the width L11 is preferably 5.36 mm.

A connecting line between two centers of the two first patches 120 of the two antenna structures 100 and 100*e* are parallel to the long side of the ground formed by the two grounds 130. A distance L14 between the two centers ranges from 5 mm to 7 mm. In the present embodiment, the distance L14 is preferably 6 mm. A distance L12 between two signal feeding ends 142 in an extension direction of the long side of the ground ranges from 4 mm to 5 mm. In the present embodiment, the distance L12 is preferably 4.3 mm. A distance L13 between the two signal feeding ends 142 in an extension direction of the short side of the ground ranges from 0.2 mm to 0.5 mm. In the present embodiment, the distance L13 is preferably 0.3 mm. Certainly, the foregoing dimensions are not limited thereto.

The antenna structure 100 on the left may have horizontal polarization of 28 GHz and vertical polarization of 39 GHz. When being disposed with a phase difference of 90 degrees from the antenna structure 100 on the left, the antenna structure 100*e* on the right may have vertical polarization of 28 GHz and horizontal polarization of 39 GHz. Designed in a space whose length L10 is 10.72 mm and whose width L11 is 5.36 mm, the two antenna structures 100 and 100*e* may support two bands and feature with an antenna in two different polarization directions, so as to achieve a single dual-polarization effect. In addition, because a distance between the antenna structures 100 and 100*e* is about half a wavelength (4.3 mm), good isolation is achieved between the antenna structures 100 and 100*e*, for example, the isolation can be greater than 20 dB.

In the present embodiment, the single dual-polarization antenna array 30 is designed by disposing the two antenna structures 100 and 100*e* with a phase difference of 90 degrees, so that 28 GHz and 39 GHz can feature with both dual band and dual polarization. When the two bands are concurrently used for wireless transmission in future, interference of a same band is prevented. Sorting and combination in antenna array design, in combination with a phase control table, provides the single dual-polarization antenna array with a feature of switching between different beams to achieve beam forming, thereby increasing a data transmission rate.

Figure 7:
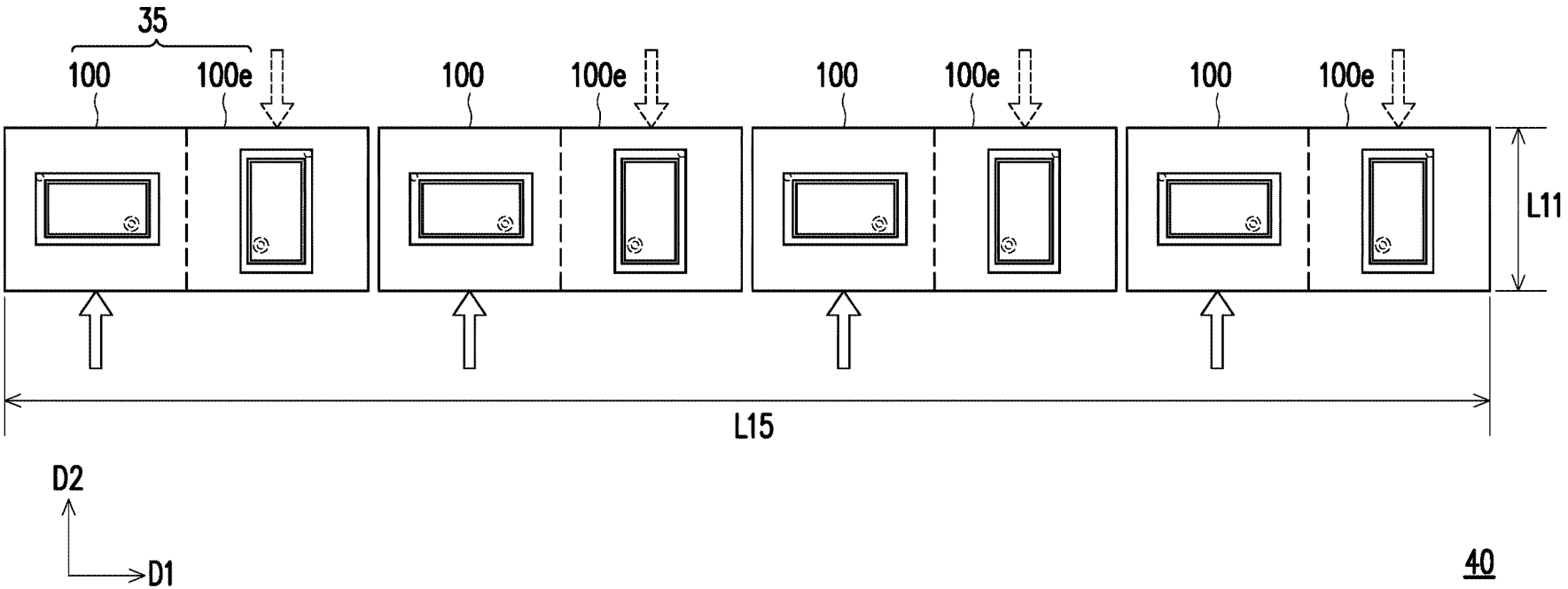
FIG. 7 is a schematic diagram of a single dual-polarization antenna array according to another embodiment of the disclosure.

FIG. 7 is a schematic diagram of a single dual-polarization antenna array according to another embodiment of the disclosure. Referring to FIG. 7, in the present embodiment, the single dual-polarization antenna array 40 includes four antenna groups 35 that are arranged as a 1×4 matrix. In other words, the antenna groups 35 are arranged in a straight line along a first direction D1. In the present embodiment, eight grounds 130 of eight antenna structures 100 and 100*e* in the four antenna groups 35 are located on a same plane, and a length L15 of a long side of a ground formed by the eight grounds 130 ranges from 40 mm to 50 mm. In the present embodiment, the length L15 is preferably 42.8 mm. A width L11 of a short side of the ground formed by the eight grounds 130 ranges from 4 mm to 6 mm. In the present embodiment, the width L11 is preferably 5.36 mm. Certainly, the foregoing dimensions are not limited thereto.

In the present embodiment, a same source may provide a same phase shift control table to an antenna structure 100 on the left in each antenna group 35, and another source may provide a same phase shift control table to an antenna structure 100*e* on the right in each antenna group 35. When the two sources provide a same phase of zero degrees to the eight antenna structures 100 and 100*e*, the eight antenna structures may form a linearly polarized antenna array. When one source provides a phase of zero degrees while the other source provides a phase of 90 degrees, the eight antenna structures may form a single dual-polarization antenna array. Simulation evaluation shows that peak gains of the single dual-polarization antenna array 40 in the present embodiment at 28 GHz and 39 GHz can both be greater than 14 dBic.

Figure 8:
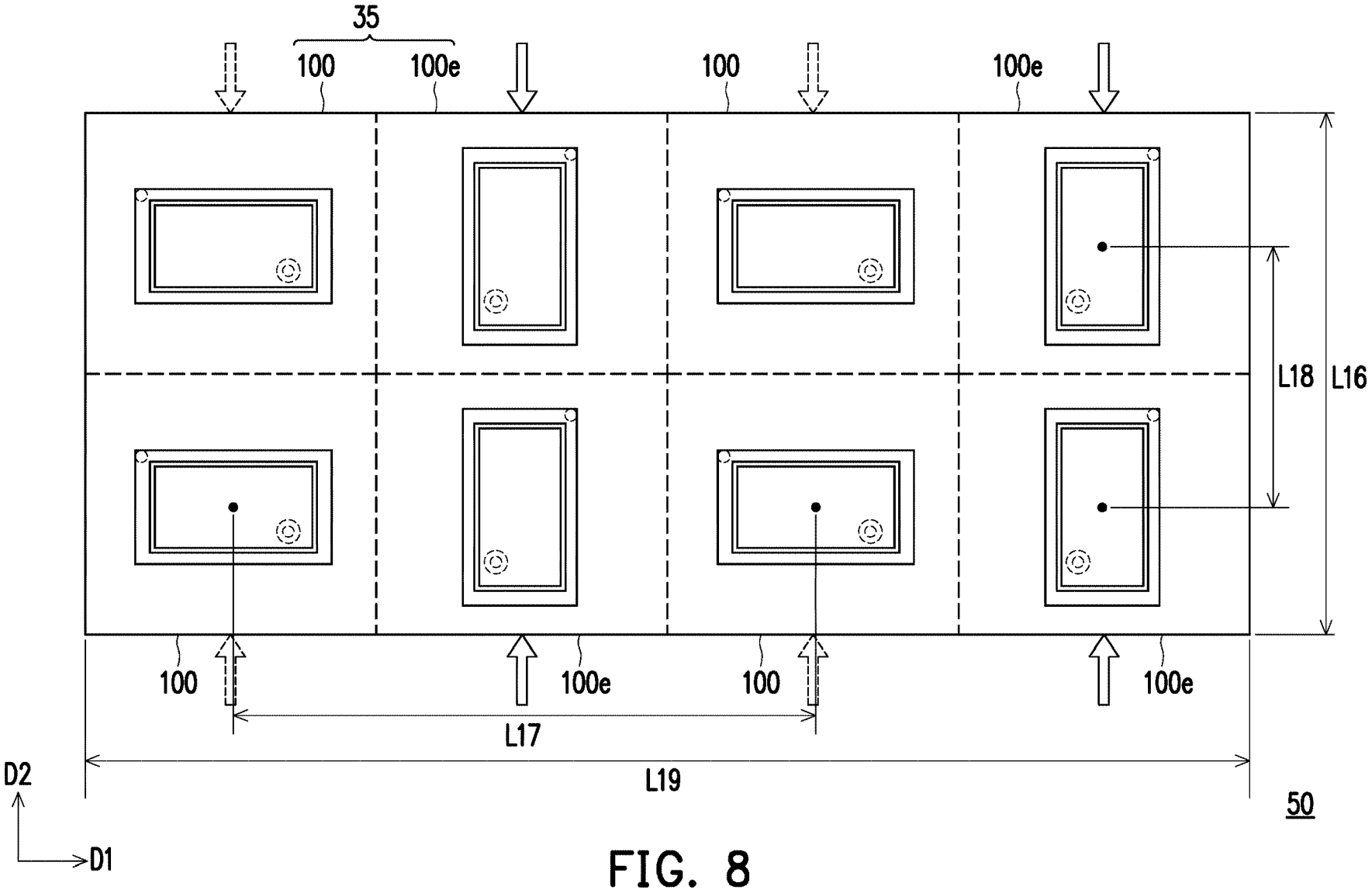
FIG. 8 is a schematic diagram of a single dual-polarization antenna array according to another embodiment of the disclosure.

FIG. 8 is a schematic diagram of a single dual-polarization antenna array according to another embodiment of the disclosure. Referring to FIG. 8, in the present embodiment, the single dual-polarization antenna array 50 includes four antenna groups 35 that are arranged as a 2×2 matrix. In the present embodiment, a long side of a ground formed by eight grounds 130 of eight antenna structures 100 and 100*e* in the four antenna groups 35 is parallel to a first direction D1, and a length L19 of the long side of the ground ranges from 14 mm to 16 mm. In the present embodiment, the length L19 is preferably 15.6 mm. A width L16 of a short side of the ground formed by the eight grounds 130 ranges from 12 mm to 15 mm. In the present embodiment, the width L16 is preferably 13.4 mm. Certainly, the foregoing dimensions are not limited thereto.

In the present embodiment, a same source may provide a same phase shift control table to an antenna structure 100 on the left in each antenna group 35, and another source may provide a same phase shift control table to an antenna structure 100*e* on the right in each antenna group 35. When the two sources provide a same phase of zero degrees to the eight antenna structures 100 and 100*e*, the eight antenna structures form a linearly polarized antenna array. When one source provides a phase of zero degrees while the other source provides a phase of 90 degrees, the eight antenna structures may form a single dual-polarization antenna array.

In addition, a distance L17 between a center of the first antenna structure 100 in the first direction D1 and a center of the third antenna structure 100 in the first direction D1 ranges from 5.5 mm to 7 mm. In the present embodiment, the distance L17 is preferably 6.4 mm, which is about 0.57 times that of a wavelength. A distance L18 between two centers of two antenna structures 100 or 100*e* in any column along a second direction D2 ranges from 5.5 mm to 7 mm. In the present embodiment, the distance L18 is preferably 6.4 mm, which is about 0.57 times that of a wavelength. The first direction D1 is perpendicular to the second direction D2. Certainly, the foregoing dimensions are not limited thereto.

Figure 9B:
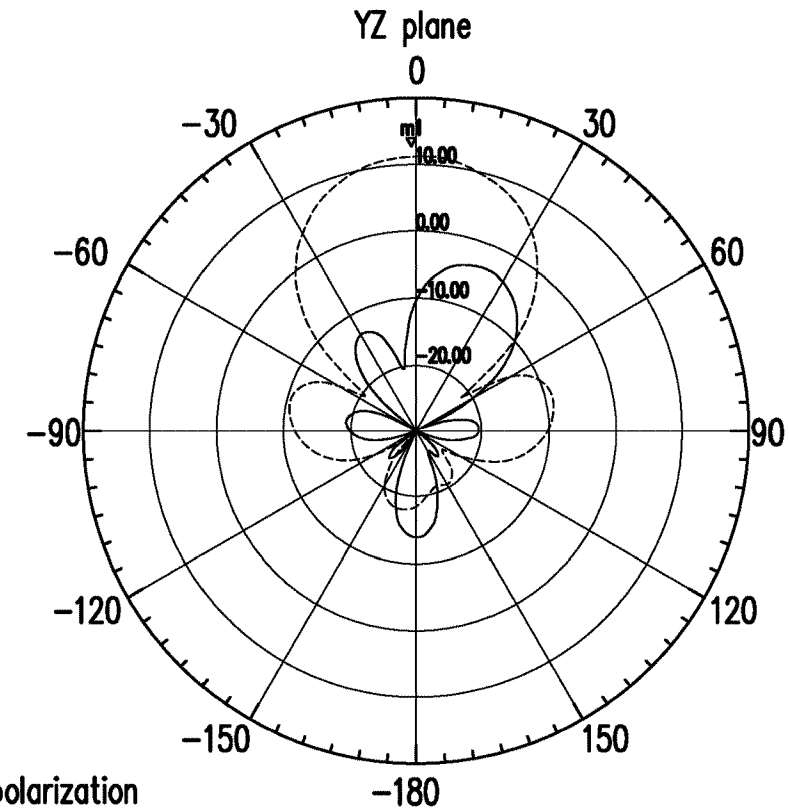
FIG. 9B is a diagram of a YZ-plane radiation pattern of the single dual-polarization antenna array shown in FIG. 8 at 28 GHz.
Figure 9A:
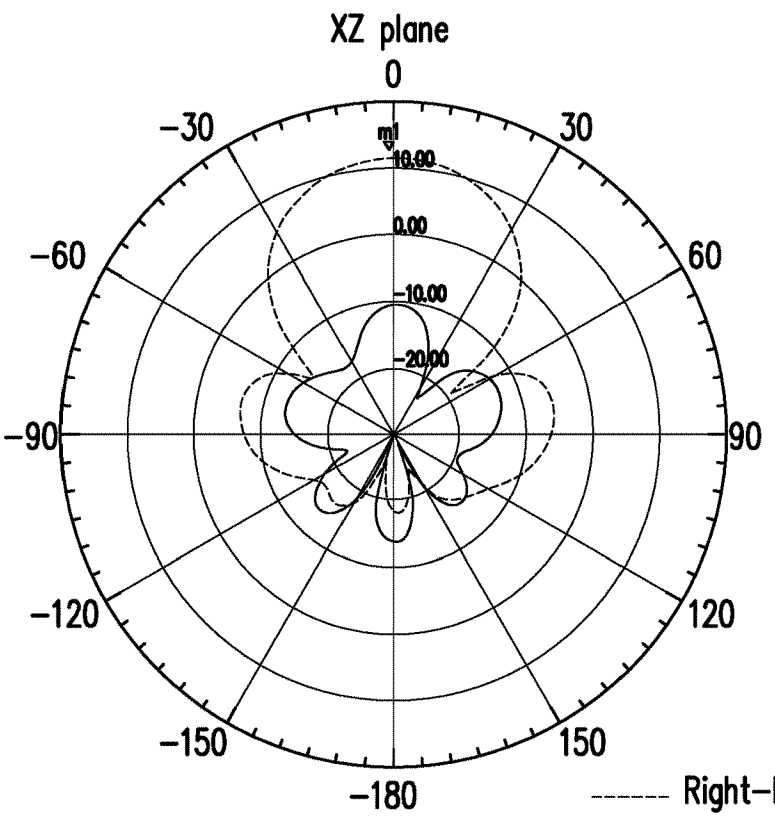
FIG. 9A is a diagram of an XZ-plane radiation pattern of the single dual-polarization antenna array shown in FIG. 8 at 28 GHz.
Figure 10B:
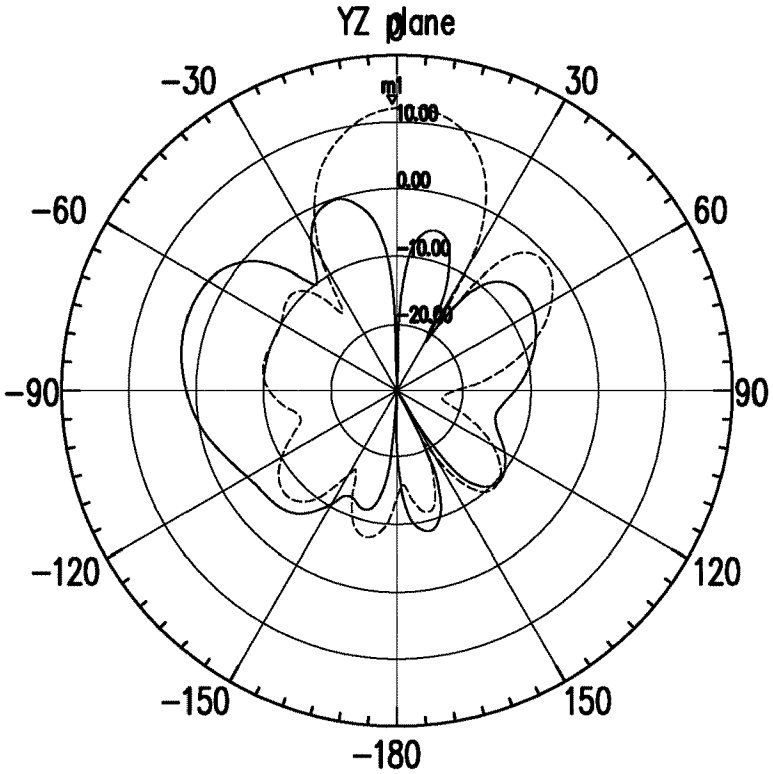
FIG. 10B is a diagram of a YZ-plane radiation pattern of the single dual-polarization antenna array shown in FIG. 8 at 39 GHz.
Figure 10A:
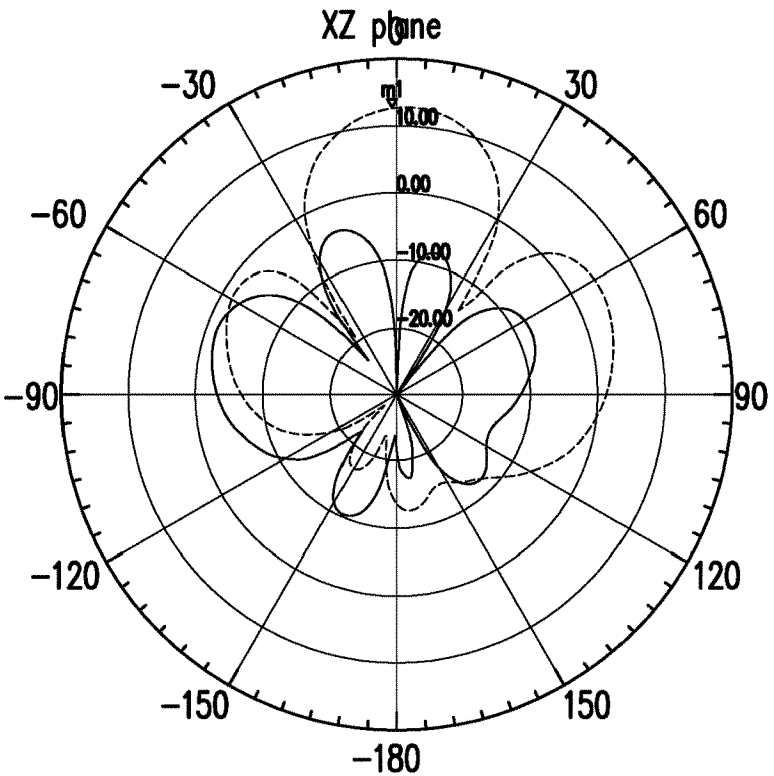
FIG. 10A is a diagram of an XZ-plane radiation pattern of the single dual-polarization antenna array shown in FIG. 8 at 39 GHz.

FIG. 9A is a diagram of an XZ-plane radiation pattern of the single dual-polarization antenna array shown in FIG. 8 at 28 GHz. FIG. 9B is a diagram of a YZ-plane radiation pattern of the single dual-polarization antenna array shown in FIG. 8 at 28 GHz. FIG. 10A is a diagram of an XZ-plane radiation pattern of the single dual-polarization antenna array shown in FIG. 8 at 39 GHz. FIG. 10B is a diagram of a YZ-plane radiation pattern of the single dual-polarization antenna array shown in FIG. 8 at 39 GHz. Referring to FIG. 9A to FIG. 10B, due to the foregoing design of the distances L17 and L18, right-hand circular polarization (RHCP) is more than 15 dBic greater than left-hand circular polarization (LHCP) with respect to performance of the single dual-polarization antenna array 50 in XZ and YZ planes of a 2D radiation pattern at frequencies of 28 GHz and 39 GHz. Therefore, the single dual-polarization antenna array 50 features with right-hand circular single dual-polarization. In the XZ and YZ planes, radiation patterns of RHCP and LHCP are also symmetrical. In addition, in the present embodiment, peak gains of the single dual-polarization antenna array 50 at 28 GHz and 39 GHz can both be greater than 11 dBic, and isolation of the single dual-polarization antenna array 50 can be greater than 10 dB.

Figure 11:
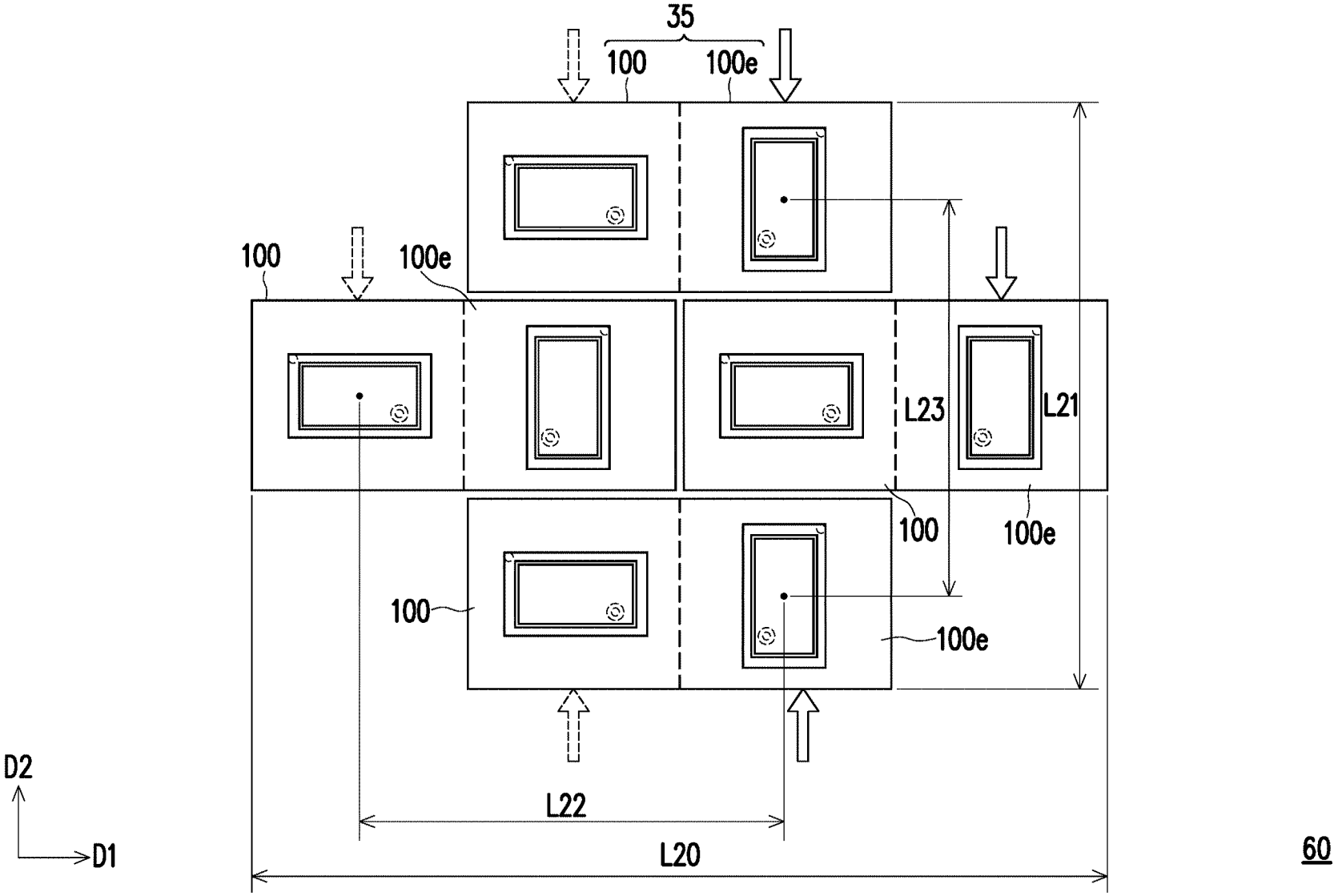
FIG. 11 is a schematic diagram of a single dual-polarization antenna array according to another embodiment of the disclosure.

FIG. 11 is a schematic diagram of a single dual-polarization antenna array according to another embodiment of the disclosure. Referring to FIG. 11, the single dual-polarization antenna array 60 in the present embodiment has four antenna groups 35 that are arranged in a first row, a second row, and a third row along a second direction D2 (an up-down direction), and the first row, the second row, and the third row extend along a first direction D1. There is one antenna group 35 in the first row, there are two antenna groups 35 in the second row, and there is one antenna group 35 in the third row.

Among two columns of antenna structures 100 and 100*e* in the middle, there are three antenna structures 100 and three antenna structures 100*e* along the second direction D2. Any adjacent two antenna structures in the two columns along the second direction D2 are disposed perpendicularly to each other, or in other words, a long patch side of one rectangular is perpendicular to a long patch side of the other rectangular. In other words, two adjacent antenna structures 100 and 100*e* in the first direction D1 (a left-right direction) are disposed perpendicularly to each other, and two adjacent antenna structures 100 and 100*e* in the second direction D2 (the up-down direction) are also disposed perpendicularly to each other.

In the present embodiment, a same source provides a same phase shift control table to an antenna structure 100 on the left in each antenna group 35, and another source provides a same phase shift control table to an antenna structure 100*e* on the right in each antenna group 35. Simulation evaluation shows that peak gains of the single dual-polarization antenna array 60 in the present embodiment at 28 GHz and 39 GHz can both be greater than 10 dBic, which indicates good performance.

In addition, a maximum length L20 of grounds 130 of the antenna structures 100 and 100*e* in the first direction D1 ranges from 14 mm to 16 mm. In the present embodiment, the length L20 is preferably 15.6 mm. A maximum length L21 of the grounds 130 in the second direction D2 ranges from 12 mm to 15 mm. In the present embodiment, the length L21 is preferably 13 mm.

In addition, a distance L22 between a center of the first antenna structure 100 or 100*e* and a center of the third antenna structure 100 or 100*e* in the first direction D1 ranges from 5.5 mm to 7 mm. In the present embodiment, the distance L22 is preferably 6.4 mm, which is about 0.57 times that of a wavelength. In addition, a distance L23 between a center of the first antenna structure 100 or 100*e* in the second direction D2 and a center of the third antenna structure 100 or 100*e* in the second direction D2 ranges from 5.5 mm to 7 mm. In the present embodiment, the distance L23 is preferably 6.4 mm, which is about 0.57 times that of a wavelength. Certainly, the foregoing dimensions are not limited thereto.

Based on the foregoing, in the antenna structure provided in the disclosure, the first patch is spaced apart from the ground, and the first patch is divided into the main patch portion of the first patch and the circular portion that surrounds the main patch portion by the circular slit. The second patch is disposed between and spaced apart from the ground and the main patch portion. The first conductive post that includes the signal feeding end extends from the second patch to the ground, and the second conductive post that includes a ground end extends from the circular portion to the ground. The design allows the second patch coupled to the first patch to form a resonant architecture including a series resonant circuit, which can cover two bands with close frequency ranges, such as 28 GHz and 39 GHz. In addition, a first antenna structure and a second antenna structure of each antenna group in a single dual-polarization antenna array provided in the disclosure are disposed perpendicularly to each other with a phase difference of 90 degrees in a first direction. The design allows two bands (for example, 28 GHz and 39 GHz) with close frequency ranges to exhibit both dual band as well as dual polarization.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An antenna structure, comprising:

a ground;

a first patch, arranged spaced apart from the ground, wherein the first patch comprises a circular slit, a main patch portion, and a circular portion, the circular portion and the circular slit surround the main patch portion, and the circular slit is located between the main patch portion and the circular portion;

a second patch, arranged spaced apart from the ground and the main patch portion, and located between the ground and the main patch portion, wherein a dimension of the second patch is less than a dimension of the main patch portion;

a first conductive post, wherein one end of the first conductive post is connected to the second patch, and another end of the first conductive post passes through the ground and is coupled to a signal feeding end; and a second conductive post, connecting the circular portion to the ground.

2. The antenna structure according to claim 1, wherein an orthographic projection of the second patch on the main patch portion is located at a main patch corner of the main patch portion.

3. The antenna structure according to claim 2, wherein the second conductive post is located at a circular portion corner, the circular portion corner is located at a diagonal position of the circular portion, and the diagonal position of the circular portion is farthest from the main patch corner of the main patch portion.

4. The antenna structure according to claim 1, wherein a width of the circular slit ranges from 0.03 mm to 0.08 mm.

5. The antenna structure according to claim 1, wherein a length of the main patch portion ranges from 2.5 mm to 3 mm and a width of the main patch portion ranges from 1.5 mm to 2 mm.

6. The antenna structure according to claim 1, wherein a length of the first patch ranges from 3 mm to 3.5 mm, a width of the first patch ranges from 2 mm to 2.5 mm, and a distance between an inner edge and an outer edge of the circular portion ranges from 0.1 mm to 0.3 mm.

7. The antenna structure according to claim 1, wherein a minimum distance between a projection of a center of the first conductive post on a plane of the first patch and a short patch side of the first patch ranges from 0.4 mm to 0.7 mm.

8. The antenna structure according to claim 1, wherein a distance between a bottom surface of the ground and a top surface of the second patch ranges from 0.5 mm to 0.9 mm, and a distance between the top surface of the second patch and a top surface of the first patch ranges from 0.03 mm to 0.07 mm.

9. The antenna structure according to claim 1, wherein a shape of the second patch is a circle or a polygon, and a radius of the second patch ranges from 0.15 mm to 0.25 mm.

10. A single dual-polarization antenna array, comprising:

at least one antenna group, each of the at least one antenna group comprising:

a first antenna structure and a second antenna structure, each of the first antenna structure and the second antenna structure comprising:

a ground;

a first patch, arranged spaced apart from the ground, wherein the first patch comprises a circular slit, a main patch portion, and a circular portion, the circular portion and the circular slit surround the main patch portion, and the circular slit is located between the main patch portion and the circular portion;

a second patch, arranged spaced apart from the ground and the main patch portion, and located between the ground and the main patch portion, wherein a dimension of the second patch is less than a dimension of the main patch portion;

a first conductive post, wherein one end of the first conductive post is connected to the second patch, and another end of the first conductive post passes through the ground and is coupled to a signal feeding end; and a second conductive post, connecting the circular portion to the ground;

wherein the first antenna structure is connected to the second antenna structure in a first direction, and the first patch of the first antenna structure and the first patch of the second antenna structure are located on a same plane and disposed perpendicularly to each other on the plane.

11. The single dual-polarization antenna array according to claim 10, wherein an orthographic projection of the second patch on the main patch portion is located at a main patch corner of the main patch portion.

12. The single dual-polarization antenna array according to claim 11, wherein the second conductive post is located at a circular portion corner, the circular portion corner is located at a diagonal position of the circular portion, and the diagonal position of the circular portion is farthest from the main patch corner of the main patch portion.

13. The single dual-polarization antenna array according to claim 10, wherein a distance between a center point of the first antenna structure and a center point of the second antenna structure ranges from 5 mm to 7 mm, and a distance between the signal feeding end of the first antenna structure and the signal feeding end of the second antenna structure ranges from 4 mm to 5 mm.

14. The single dual-polarization antenna array according to claim 10, wherein a quantity of the at least one antenna group is four and the four antenna groups are arranged in a straight line along the first direction.

15. The single dual-polarization antenna array according to claim 10, wherein a quantity of the at least one antenna group is 4 and the four antenna groups are arranged into a 2×2 matrix.

16. The single dual-polarization antenna array according to claim 10, wherein a quantity of the at least one antenna group is four and the four antenna groups are arranged in a first row, a second row, and a third row along a second direction, the first row, the second row, and the third row extend along the first direction, a quantity of the at least antenna group in the first row is one, a quantity of the at least antenna groups in the second row is two, and a quantity of the at least antenna group in the third row is one.

* * * * *